US007205508B2

(12) United States Patent
Sakanoue et al.

(10) Patent No.: US 7,205,508 B2
(45) Date of Patent: Apr. 17, 2007

(54) SHOWCASE

(75) Inventors: Kenji Sakanoue, Gyouda (JP); Kouji Hayase, Ota (JP); Kazuo Tetsukawa, Isesaki (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 0 days.

(21) Appl. No.: 11/055,108

(22) Filed: Feb. 11, 2005

(65) Prior Publication Data

US 2005/0194368 A1 Sep. 8, 2005

(30) Foreign Application Priority Data

Mar. 3, 2004 (JP) ..... 2004-059284

(51) Int. Cl.

| | |
|---|---|
| ***H05B 3/84*** | (2006.01) |
| ***A47J 36/24*** | (2006.01) |
| ***A47F 3/00*** | (2006.01) |
| ***A47F 5/00*** | (2006.01) |

(52) U.S. Cl. ..... 219/403; 219/385; 219/386; 219/402; 219/428; 312/236

(58) Field of Classification Search ..... 219/214, 219/403, 385; 99/467; 312/128, 236; 326/125
See application file for complete search history.

(56) References Cited

U.S. PATENT DOCUMENTS

| | | | | |
|---|---|---|---|---|
| 2,758,193 | A * | 8/1956 | Mantofel | 219/214 |
| 3,632,968 | A * | 1/1972 | Wilson | 219/214 |
| 4,036,401 | A * | 7/1977 | Nachtigall, Jr. | 221/150 A |
| 4,822,981 | A * | 4/1989 | Chaudoir | 219/385 |
| 5,771,959 | A * | 6/1998 | Westbrooks et al. | 165/11.1 |
| 6,119,587 | A * | 9/2000 | Ewald et al. | 99/483 |
| 6,259,065 | B1 * | 7/2001 | Hohler et al. | 219/400 |
| 6,265,695 | B1 * | 7/2001 | Liebermann | 219/385 |
| 6,344,630 | B1 * | 2/2002 | Jarvis et al. | 219/386 |

(Continued)

FOREIGN PATENT DOCUMENTS

GB 1 275 965 6/1972

(Continued)

OTHER PUBLICATIONS

Patent Abstracts Of Japan vol. 2000, No. 07, Sep. 29, 2000 & JP 2000 102462 A (Itoki Crebio Corp), Apr.11, 2000 *abstract*.

(Continued)

*Primary Examiner*—Joseph Pelham
(74) *Attorney, Agent, or Firm*—Armstrong, Kratz, Quintos, Hanson & Brooks, LLP

(57) ABSTRACT

A showcase including an electric heater in a rack. The rack can be inexpensively constituted to be light in weight, and processing of an electric heater leader line can be facilitated. The showcase includes the electric heater in the rack for displaying commercial goods. The rack includes a metal main body and edge members made of resins. The edge members are mounted to front and rear parts of the main body. An insertion hole for mounting a partition member to partition the rack is formed in the edge member. An insertion hole for mounting a guard to prevent falling of the commercial goods is formed in the edge member mounted to a front edge of the main body.

6 Claims, 10 Drawing Sheets

U.S. PATENT DOCUMENTS

| | | | | |
|---|---|---|---|---|
| 6,658,994 | B1 * | 12/2003 | McMillan | 99/468 |
| 6,707,008 | B2 * | 3/2004 | Roehr et al. | 219/385 |

FOREIGN PATENT DOCUMENTS

| | | | |
|---|---|---|---|
| GB | 1 403 849 | | 8/1975 |
| GB | 2 388 185 | | 11/2003 |
| JP | 2000102462 | * | 4/2000 |
| JP | 2000102462 A | * | 11/2000 |
| JP | 2003194453 | * | 7/2003 |
| JP | 2003194453 A | * | 7/2003 |
| JP | 2003250675 A | * | 9/2006 |
| NL | 9 500 143 | | 9/1996 |

OTHER PUBLICATIONS

Patent Abstracts Of Japan vol. 2003, No. 12, Dec. 5, 2003 & JP 2003 250675 A (Sanden Corp), Sep. 9, 2003 *abstract*.

Patent Abstracts Of Japan vol. 2003, No. 11, Nov. 5, 2003 & JP 2003 194453 A (Sanden Corp), Jul. 9, 2003 *abstract*.

European Search Report of Jun. 6, 2005.

* cited by examiner

SHOWCASE

BACKGROUND OF THE INVENTION

1. Field of the Invention

The present invention relates to a showcase which comprises an electric heater in a rack for displaying commercial goods.

2. Description of the Related Art

The showcase of this type has conventionally been installed in a store such as a supermarket or a convenience store, and used for displaying and selling commercial goods. Especially, a hot drink sale showcase for warming and selling canned drinks or plastic-bottled drinks comprises, for example, a display room surrounded with transparent glass. A plurality of racks are installed in the display room, and commercial goods are displayed on the racks. A front surface or front and rear surfaces of the display room are freely opened/closed by a door made of transparent glass, and the rack is fixed to rack supporting columns erected at four corners of the display room. In the display room, cold air heat-exchanged with a cooler disposed in a lower part is circulated to set a predetermined refrigeration temperature.

While the lower part of the display room is a usual net rack, a rack of an upper part is made of a metal plate, and an electric heater is mounted thereto. In the case of warming commercial goods on the rack of the upper part, a system has been employed which partitions a portion above the rack from the display room below, conducts electricity to the electric heater in a state of blocking the circulation of cold air, and heats the entire metal rack to warm commercial goods on the rack (ex., Japanese Patent Application Laid-Open Nos. 2003-194453 and 2003-250675).

However, the entire rack for warming has conventionally been assembled by using metal plates, causing problems of heavy weight and costs. Additionally, burdensome work has been necessary for processing a leader line of the electric heater.

SUMMARY OF THE INVENTION

The present invention has been made to solve the aforementioned conventional technical problems, and it is an object of the invention to provide a showcase equipped with an electric heater in a rack, and capable of inexpensively constituting the rack to be light in weight and facilitating processing of a leader line of the electric heater.

That is, the showcase of the invention includes an electric heater in a rack for displaying commercial goods. The rack includes a metal main body and edge members made of resins.

According to the showcase of the invention, the edge members are mounted to front and rear parts of the main body.

According to the showcase of the invention, mounting portions for mounting a partition member to partition the rack are formed in the edge members.

According to the showcase of the invention, a mounting portion for mounting a guard to prevent falling of the commercial goods is formed in the edge member mounted to a front edge of the main body.

According to the showcase of the invention, a mounting portion for mounting a commercial goods indicator is formed in the edge member mounted to the front edge of the main body.

According to the showcase of the invention, a leader line receiving portion of the electric heater is disposed in the edge member.

According to the showcase of the invention, a cap for covering the leader line receiving portion in a freely opened/closed manner is disposed in the edge member.

According to the showcase of the invention, an engaging portion is formed to be inserted and fixed in an engaging hole formed in a supporting column to fix the rack, and a groove is formed in a tip of the engaging portion.

DETAILED DESCRIPTION OF THE PREFERRED EMBODIMENT

Figure 1:
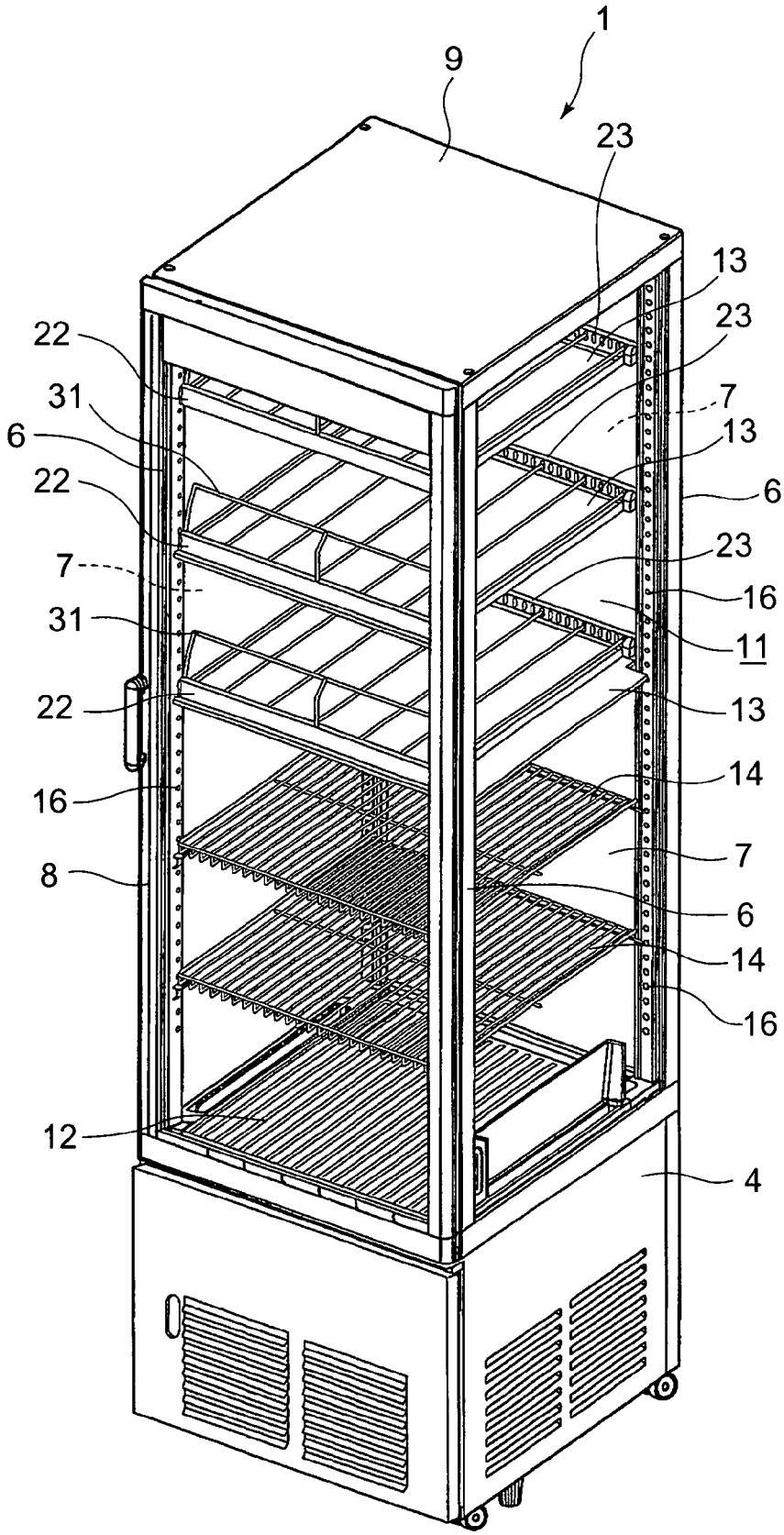
FIG. 1 is a perspective view of a showcase according to an embodiment of the present invention.
Figure 2:
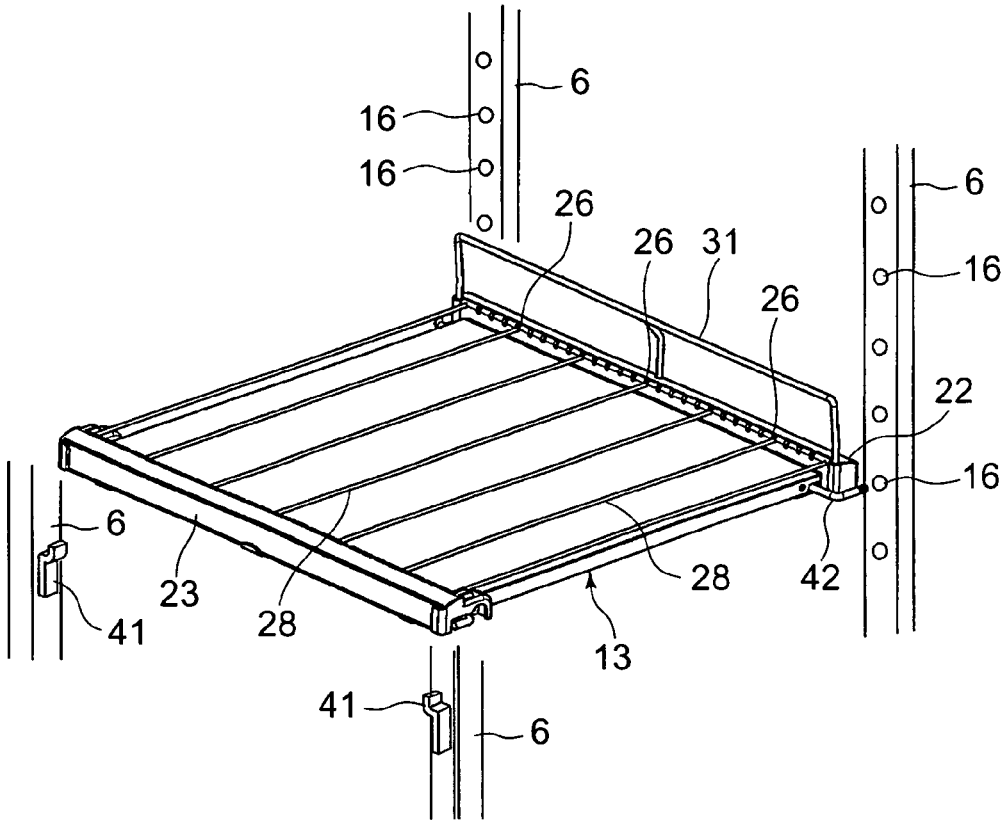
FIG. 2 is an expanded perspective view of a rack portion of the showcase of FIG. 1.
Figure 3:
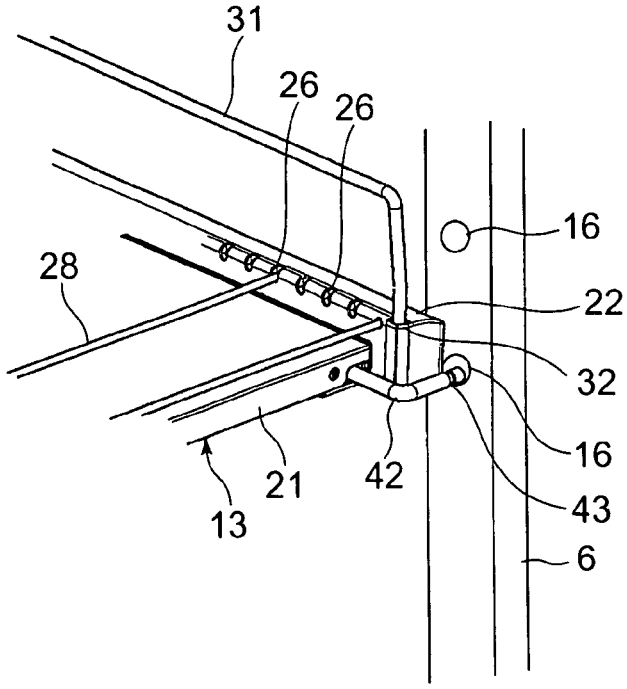
FIG. 3 is an expanded perspective view of a rack and a supporting column of the showcase of FIG. 1.

Next, the preferred embodiment of the present invention will be described in detail with reference to the accompanying drawings. A showcase 1 of a four-surface glass type according to an embodiment of the invention includes supporting columns 6 erected at four corners of an insulated wall 4, left, right and rear transparent walls (made of transparent glass) 7 fitted to the supporting columns 6, a front opened/closed door (transparent wall made of transparent glass) 8, and a top wall 9. A display room 11 surrounded with the transparent walls 7, the opened/closed door 8 and the top wall 9 is constituted on the insulated wall 4.

A machine room (not shown) is constituted in a lower part of the insulated wall 4. A compressor and a condenser are installed in the machine room to constitute a refrigerant cycle of a cooling device. A cooler and a blower are installed below a bottom wall 12 mounted on the insulated wall 4 to constitute the refrigerant cycle of the cooling device. Cold air heat-exchanged with the cooler is circulated in the display room 11 by the blower, whereby the inside of the display room 11 can be cooled to a predetermined refrigeration temperature.

Five vertical stages of racks 13, 13, 13, 14 and 14 for displaying commercial goods are installed in the display room 11. In this case, the racks 13 and 14 are installed by being engaged with a plurality of engaging holes 16 formed in the supporting columns 6 at predetermined intervals up and down, and the lower two stages of racks 14 are net racks.

Figure 4:
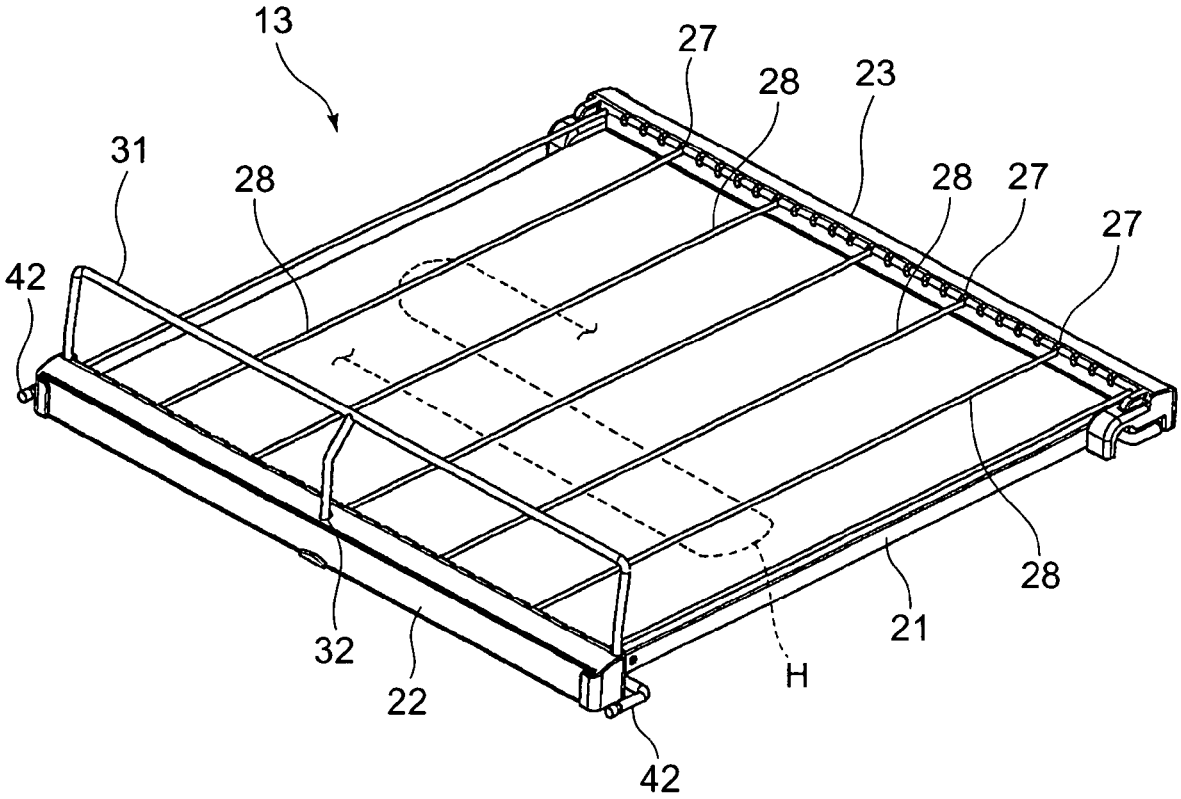
FIG. 4 is a front perspective view of the rack of the showcase of FIG. 1.
Figure 5:
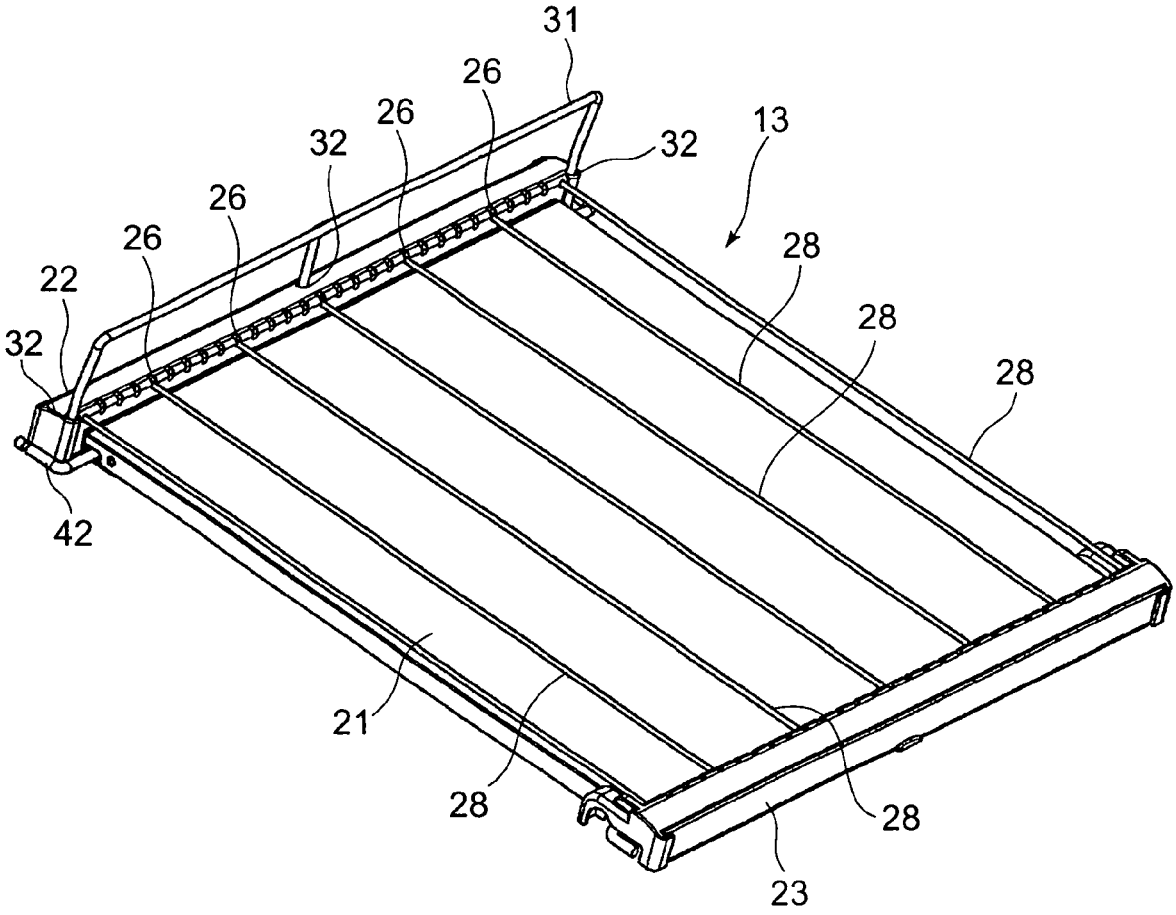
FIG. 5 is a rear perspective view of the rack of FIG. 4.

On the other hand, the upper three stages of racks 13 can warm and sell commercial goods. That is, as shown in FIGS. 4, 5, the rack 13 includes a main body 21 made of a rectangular metal plate, edge members 22, 23 made of hard resins and mounted to front and rear edges of the main body 21, and the like. An electric heater H is mounted to an inner surface of the main body 21. In the case of warming and selling commercial goods such as canned drinks or plastic-bottled drinks on the racks 13, in a state of stopping upward cold air circulation from the lowest rack 13, electricity is conducted to the electric heater H to heat the commercial goods on the main body 21 of the rack 13.

Figure 6:
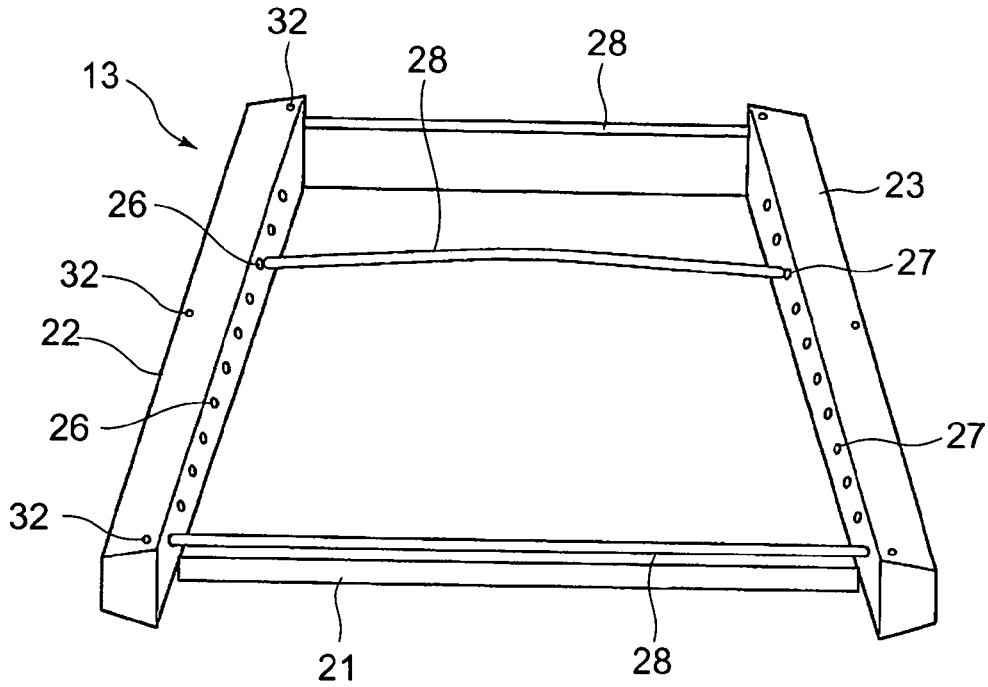
FIG. 6 is another perspective view of the rack of FIG. 4.

In the edge members 22, 23, pluralities of insertion holes (mounting portions) 26, 27 are integrally formed at predetermined intervals in opposing positions on the main body 21. As shown in FIG. 6, front and rear edges of a linear partition member 28 (metal thin bar) are inserted into the insertion holes 26, 27 of the opposing positions back and forth and fixed. The partition member 28 partitions the rack 13 (main body 21) left and right in accordance with widths of the commercial goods. The fixing of the partition member 28 can be achieved by using its elasticity to bend it, for example, in a state in which one end is inserted, and inserting the other end.

Figure 7:
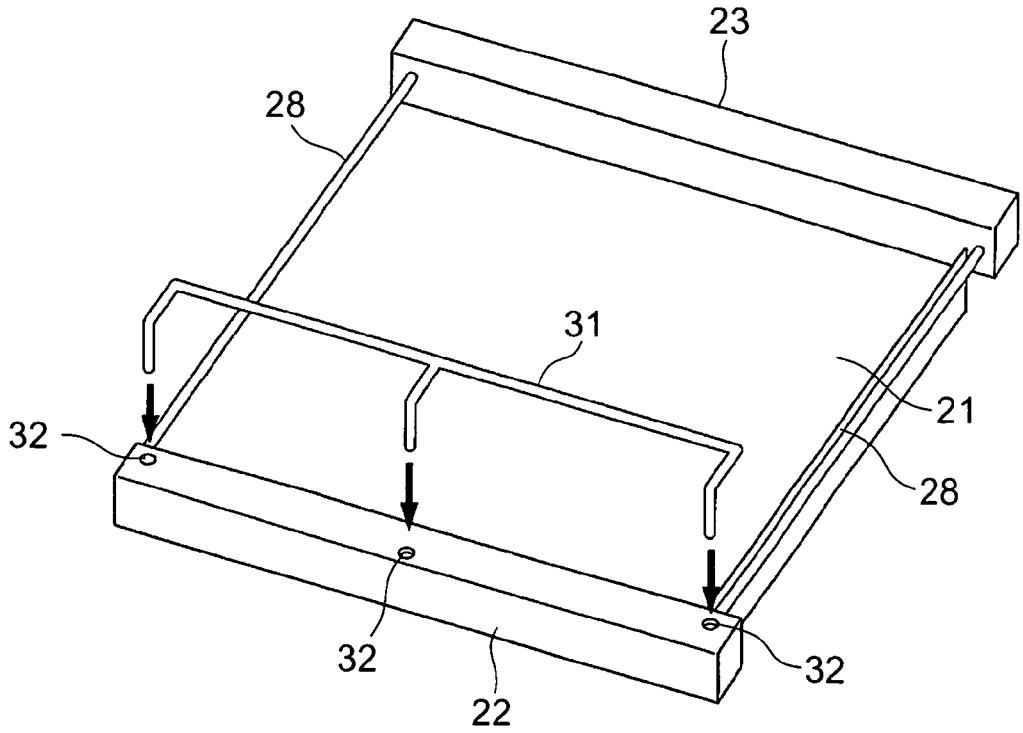
FIG. 7 is yet another perspective view of the rack of FIG. 4.
Figure 8:
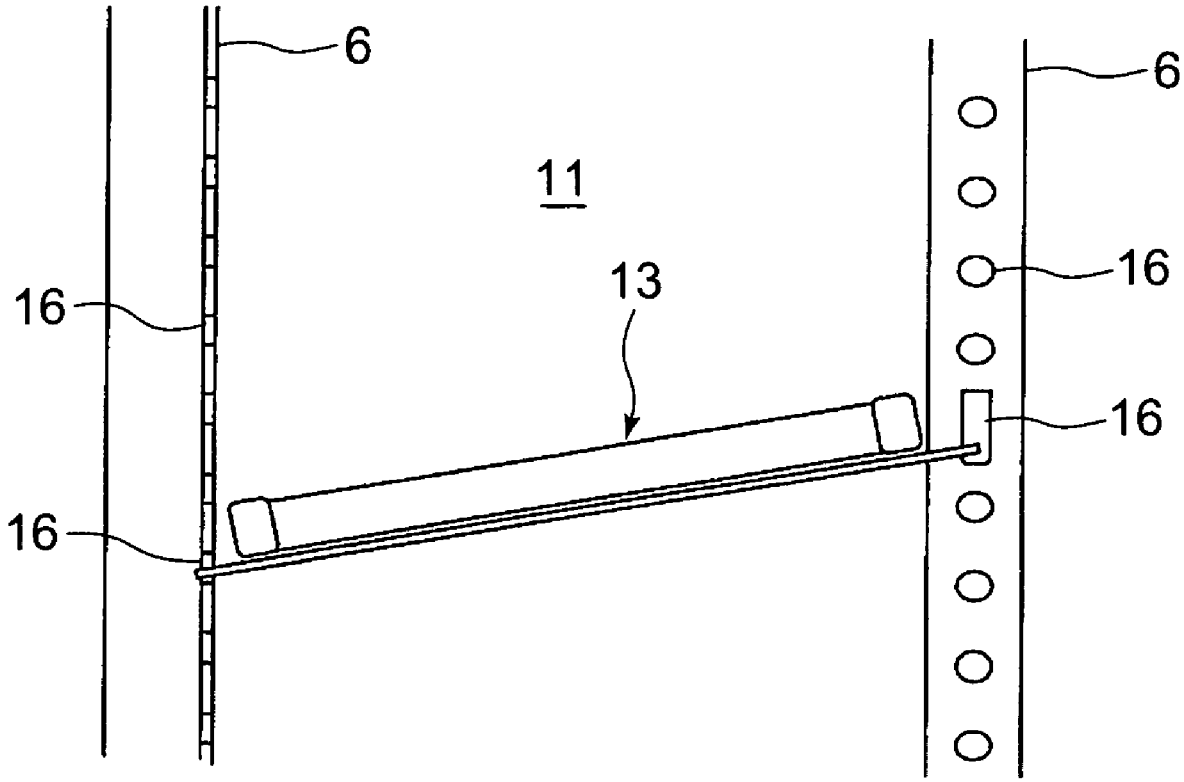
FIG. 8 is a side view of a state in which the rack is inclined and installed in the showcase of FIG. 1.

As shown in FIG. 7, a guard 31 is mounted to the front edge member 22 to prevent falling of the commercial goods when the rack 13 is installed in a state of being inclined low obliquely to the front. In this case, insertion holes (mounting holes) 32 are integrally formed in an upper surface of the edge member 22, and the guard 31 is inserted into these insertion holes 32 from above and fixed as shown in FIG. 7.

Figure 9:
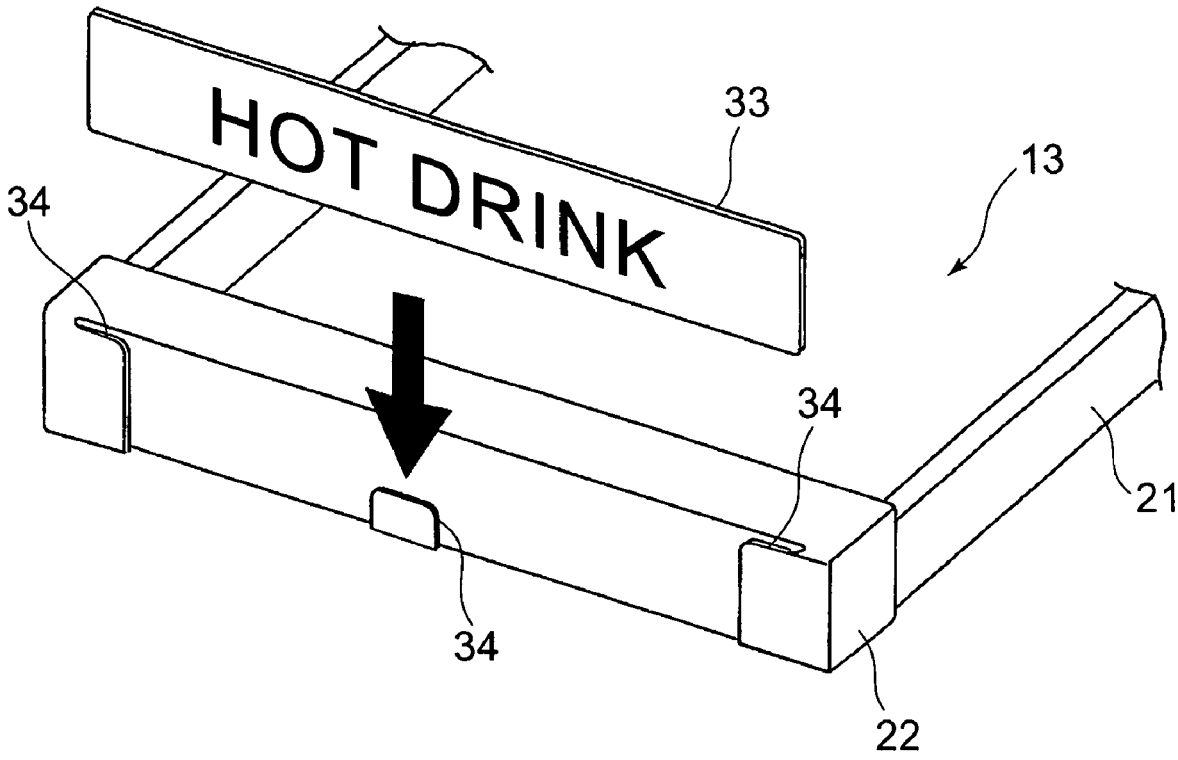
FIG. 9 is a perspective view of a front end of the rack of FIG. 4.

Furthermore, grooves (mounting portions) 34 are integrally formed in a front surface of the front edge member 22 to mount a commercial goods indicator 33 such as a thermometer for indicating warmed commercial goods or a temperature of the commercial goods. A shown in FIG. 9, the commercial goods indicator 33 is mounted to the front surface of the rack 13 by inserting both ends and a center thereof into the grooves 34.

On the other hand, as shown in FIGS. 10 to 14, in the rear edge member 23, a leader line receiving portion 36 is recessed to open downward. A leader line (power supply line) H1 of the electric heater H is received in the leader line receiving portion 36 (electric heater H is not shown in FIGS. 11, 12). At this time, the receiving is easy because an entire bottom surface of the leader line receiving portion 36 is open. Additionally, the bottom surface opening of the leader line receiving portion 36 is covered with a rotatable cap 37 to be freely opened/closed. Accordingly, falling-off of the leader line H1 is prevented, and the leader line H1 is concealed from the outside, thereby improving appearance.

Figure 10:
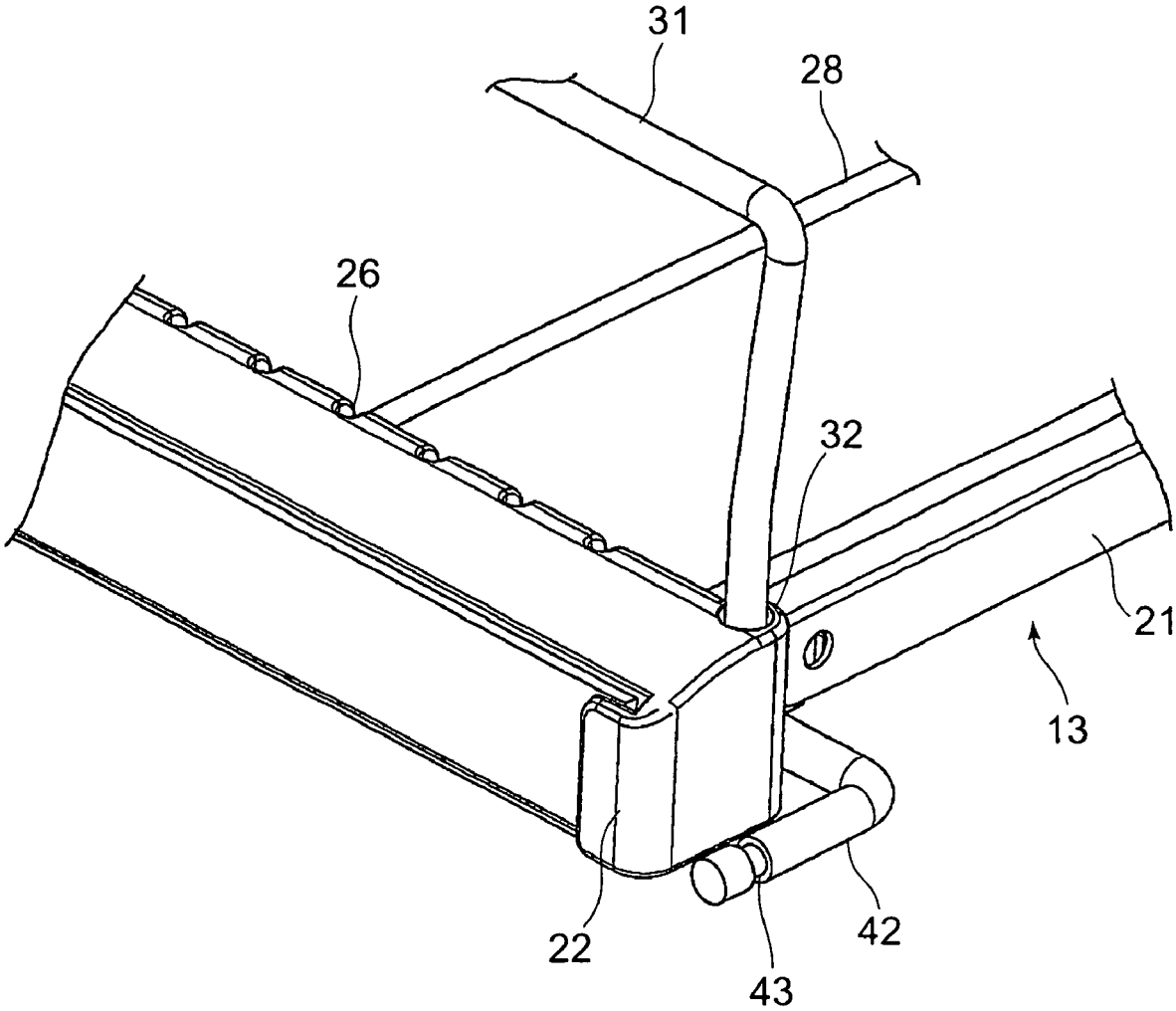
FIG. 10 is an expanded perspective view of a front end corner of the rack of FIG. 4.
Figure 11:
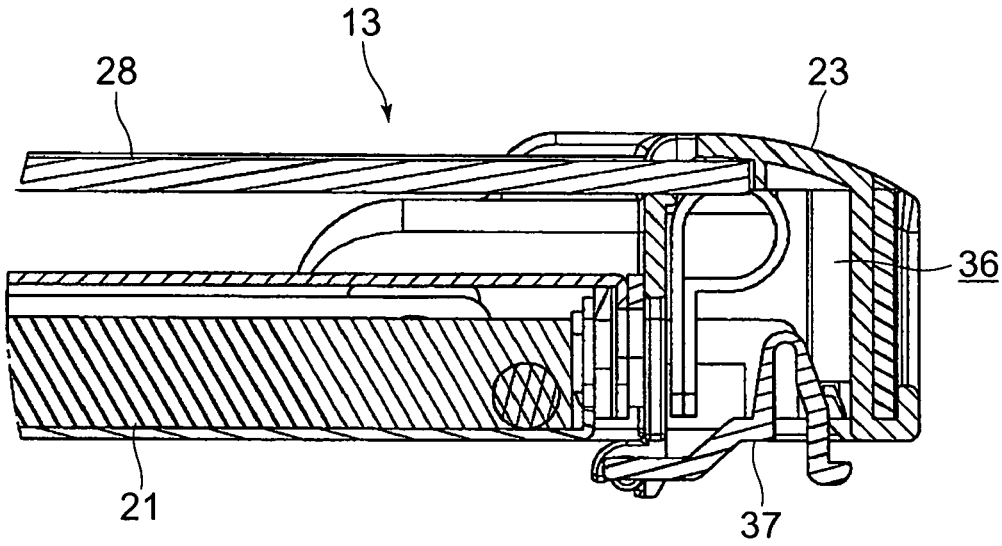
FIG. 11 is a rear vertical side view of the rack of FIG. 4.
Figure 12:
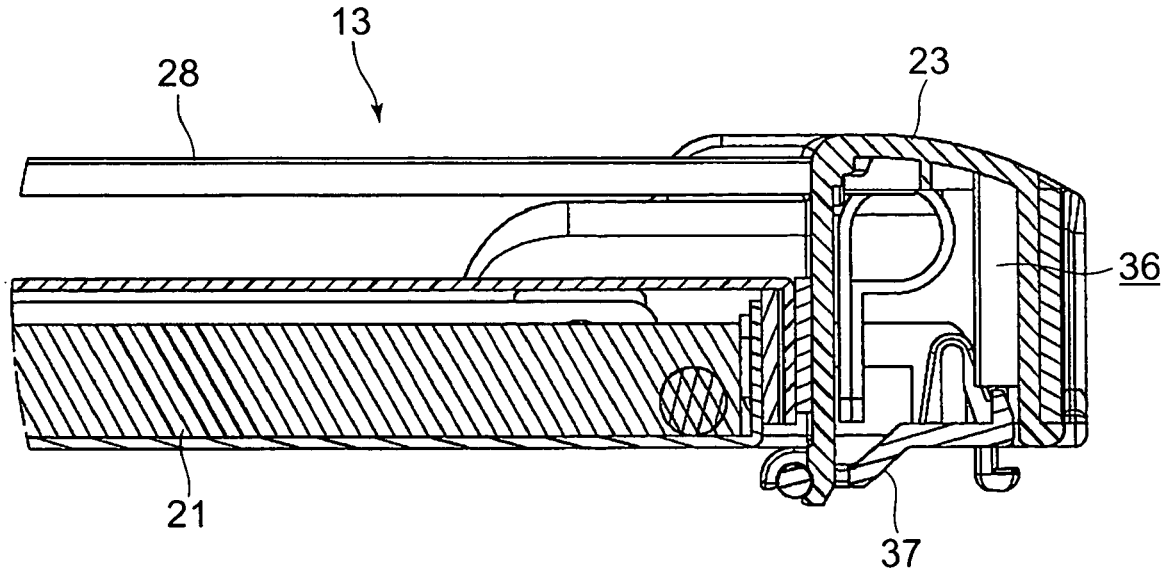
FIG. 12 is another rear vertical side view of the rack of FIG. 4.
Figure 13:
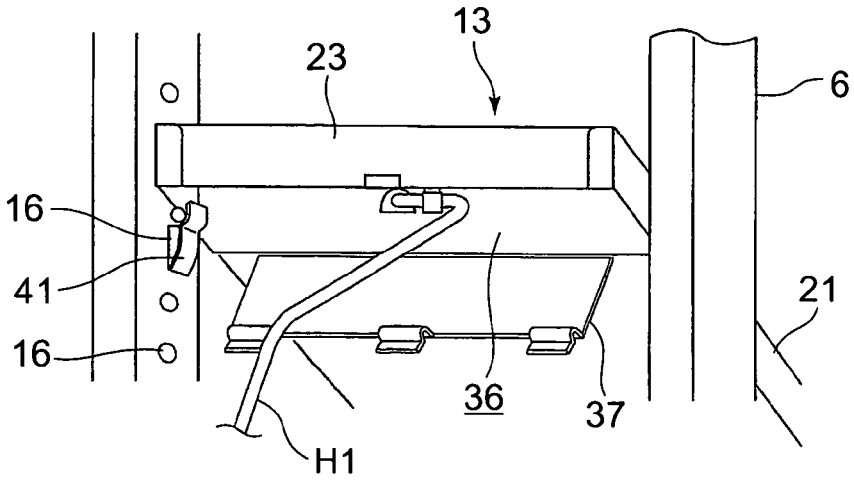
FIG. 13 is a lower perspective view of a rack rear portion in a state in which the rack is installed in the showcase of FIG. 1.
Figure 14:
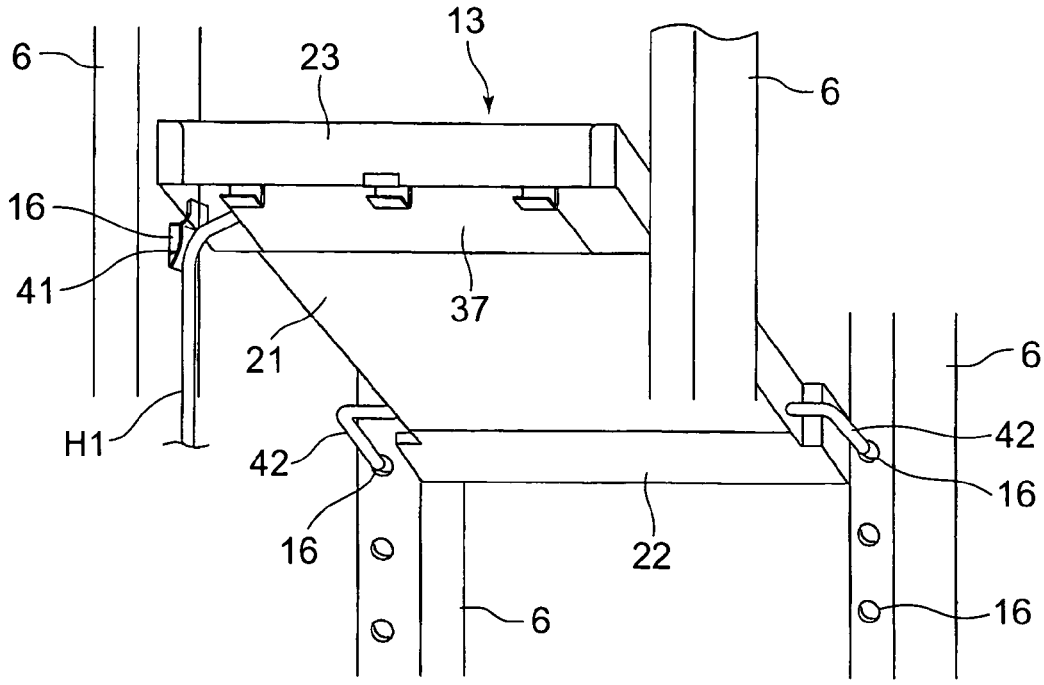
FIG. 14 is another lower perspective view of the rack rear portion in the state in which the rack is installed in the showcase of FIG. 1.

Here, both rear sides of the rack 13 are held by the engaging holes 16 through receiving members 41, while both front sides are held by inserting engaging portions 42 into the engaging holes 16. That is, the engaging portions 42 made of steel bars are mounted to the inside of the front edge of the main body 21 to project outward on both sides and to bend forward. A groove 43 is cut in a tip of the engaging portion 42 (FIG. 10). When the engaging portions 42, 42 are inserted into the engaging holes 16, 16 of the supporting columns 6, 6 of both front sides, the grooves 43 are engaged with edges of the engaging holes 16. Accordingly, the rack 13 can be stably fixed to the supporting column 6.

In this case, for example, when the engaging portion 42 is crushed to be rectangular and made difficult to be pulled out when it is inserted into the engaging hole 16, the engaging hole 16 itself must be enlarged, causing a strength problem of the supporting column 6. However, a size of the engaging portion 42 is not increased when the groove 43 is cut as in the case of the invention. Thus, it is not necessary to enlarge the engaging hole 16, and a reduction in strength of the supporting column 6 is prevented.

The embodiment has been described by taking the example of the four-surface glass type showcase. Not limited to this, however, the invention can be applied to general showcases which comprise racks having electric heaters.

As described above, according to the present invention, in the showcase constituted by disposing the electric heater in the rack for displaying the commercial goods, the rack includes the metal main body and the resin edge members. Thus, for example, by mounting the edge members to the front and rear parts of the main body, it is possible to easily form the mounting portions for mounting the partition member to partition the rack in the resin edge members.

The mounting portion for mounting the guard to prevent the falling of the commercial goods can be easily formed in the front edge member, and the mounting portion for mounting the commercial goods indicator can be easily formed. Thus, it is possible to reduce production costs while reducing the weight of the rack equipped with the electric heater.

The leader line of the electric heater can be easily received by disposing the leader line receiving portion of the electric heater in the edge member. Especially, by disposing the cap in the edge member to cover the leader line receiving portion in the freely opened/closed manner, it is possible to stably receive the leader line, and to improve appearance.

Furthermore, the groove is formed in the tip of the engaging portion inserted and fixed into the engaging hole formed in the supporting column for fixing the rack. Thus, by engaging the groove with the edge of the engaging hole in the state in which the engaging portion is inserted into the engaging hole, it is possible to stably fix the rack to the supporting column. In this case, the size of the engaging portion is not increased. Thus, it is not necessary to enlarge the engaging hole, and it is possible to prevent a reduction in the strength of the supporting column.

What is claimed is:

1. A showcase comprising:

an electric heater in a rack for displaying commercial goods, wherein the rack comprises a metal main body and edge members made of resins mounted to front and rear parts of the main body, wherein said electric heater is mounted to an inner surface of said main body such that there is no air gap between said inner surface of said main body and said electric heater, and wherein mounting portions consisting of horizontal holes for mounting at least one partition member to partition the rack are formed in the edge members.

2. The showcase according to claim 1, wherein a mounting portion for mounting a guard to prevent falling of the commercial goods is formed in the edge member mounted to a front edge of the main body.

3. The showcase according to claim 1, wherein a mounting portion for mounting a commercial goods indicator is formed in the edge member mounted to the front edge of the main body.

4. The showcase according to claim 1, wherein a leader line receiving portion of the electric heater is disposed in the edge member.

5. The showcase according to claim 4, wherein a cap for converting the leader line receiving portion in a freely opened/closed manner is disposed in the edge member.

6. The showcase according to claim 1, wherein an engaging portion is formed to be inserted and fixed in an engaging hole formed in a supporting column to fix the rack, and a groove is formed in a tip of the engaging portion.

* * * * *